US006612281B1

(12) United States Patent
Martin

(10) Patent No.: US 6,612,281 B1
(45) Date of Patent: Sep. 2, 2003

(54) PISTON/CRANKSHAFT ASSEMBLY

(76) Inventor: Larry K. Martin, 15141 N. Fairmount Dr., Edinburgh, IN (US) 46124-9186

( * ) Notice: Subject to any disclaimer, the term of this patent is extended or adjusted under 35 U.S.C. 154(b) by 0 days.

(21) Appl. No.: 10/095,160

(22) Filed: Mar. 12, 2002

(51) Int. Cl.[7] ..... F02B 75/32
(52) U.S. Cl. ..... 123/197.4
(58) Field of Search ..... 123/197.4, 197.1, 123/54.1, 54.4, 53.1, 53.3, 53.5, 54.8, 197.3, 197.2

(56) References Cited

U.S. PATENT DOCUMENTS

| | | | | |
|---|---|---|---|---|
| 1,956,804 A | | 5/1934 | Meyer | |
| 4,708,096 A | | 11/1987 | Mroz | |
| 4,945,866 A | * | 8/1990 | Chabot, Jr. | 123/53.1 |
| 4,974,554 A | | 12/1990 | Emery | |
| 5,076,220 A | | 12/1991 | Evans et al. | |
| 5,146,884 A | | 9/1992 | Merkel | |
| 5,186,127 A | | 2/1993 | Cuatico | |
| 5,215,051 A | | 6/1993 | Smith | |
| 5,297,448 A | | 3/1994 | Galvin | |
| 5,544,627 A | | 8/1996 | Terziev et al. | |
| 5,816,201 A | | 10/1998 | Garvin | |
| 6,058,901 A | * | 5/2000 | Lee | 123/197.1 |

FOREIGN PATENT DOCUMENTS

| | | | | |
|---|---|---|---|---|
| JP | 02149731 A | * | 6/1990 | F02B/75/32 |

* cited by examiner

*Primary Examiner*—Henry C. Yuen
*Assistant Examiner*—Hyder Ali
(74) *Attorney, Agent, or Firm*—Donald R. Schoonover

(57) ABSTRACT

A piston/cylinder combination is oriented to be at an oblique angle with respect to the axis of rotation of a crankshaft of an internal combustion engine so power during a power stroke of the piston is applied directly to the crankshaft and additional degrees of rotation of the crankshaft can be realized for the power stroke of the piston.

4 Claims, 4 Drawing Sheets

INDUCTION STROKE

COMPRESSION STROKE

POWER STROKE (INITIATED BY IGNITION)

EXHAUST STROKE

PISTON/CRANKSHAFT ASSEMBLY

BACKGROUND OF THE INVENTION

1. Field of the Invention

The present invention relates to the general art of internal combustion engines, and to the particular field of relative piston cylinder/crankshaft orientation of internal combustion engines.

2. Discussion of the Related Art

Efficiency in internal combustion engines has always been an important concern to engine designers. Operating efficiency is important to internal combustion designers for several reasons, including fuel economy, engine reliability, exhaust gas control and the like.

Accordingly, the internal combustion engine art contains many examples of internal combustion engines which are intended to improve operating efficiency. However, with the increasing demands being placed on modern internal combustion engines, further improvements are needed.

Therefore, there is a need for an internal combustion engine which operates more efficiently than presently-available internal combustion engines.

One area in which improved internal combustion engine efficiency can be realized is in the power stroke of the engine. if more power can be obtained from a power stroke, internal combustion engine efficiency will be improved over presently-available internal combustion engines.

To this end, the internal combustion engine art contains designs that offset a piston cylinder with respect to a crankshaft in order to increase the efficiency of power transfer between the piston and the crankshaft during the power stroke of the piston. However, while somewhat effective, the simple offsetting of the piston cylinder with respect to the crankshaft does not significantly increase power efficiency because the power stroke is not increased in such internal combustion engine design.

Therefore, there is a need for an internal combustion engine in which the efficiency of the power stroke of the piston is increased.

PRINCIPAL OBJECTS OF THE INVENTION

It is a main object of the present invention to improve the efficiency of internal combustion engines.

It is another object of the present invention to improve the efficiency of the power stroke of an internal combustion engine piston.

SUMMARY OF THE INVENTION

These, and other, objects are achieved by an internal combustion engine comprising a piston cylinder having a longitudinal axis and a reference plane which contains the longitudinal axis, a crankshaft having a longitudinal axis and an axis of rotation around the longitudinal axis, a reference point on the crankshaft which moves between a twelve o'clock location and a three o'clock location as the crankshaft rotates about the axis of rotation, a reference plane in the crankshaft that contains the twelve o'clock location and the six o'clock location on the crankshaft, a piston movably mounted in the piston cylinder to move in a power stroke within the piston cylinder, a connecting rod connecting the piston to the crankshaft and transferring power to the crankshaft from the piston during the power stroke of the piston, and the reference plane of the piston cylinder being oriented at an oblique angle to the reference plane of the crankshaft.

By using the internal combustion engine embodying the teaching of the present invention, the top dead center point at a wrist pin location will remain the same as in the prior art, but the bottom dead center location is moved over to place a more direct force on the crankshaft in the downside power stroke. A gain in degrees of crankshaft rotation will be realized on both power and intake strokes, while the degree of crankshaft rotation on exhaust and compression will be less. The engine embodying the teaching of the present invention moves the cylinder centerline bottom dead center location over to align the motion of the piston in a more direct angle for the transfer of force to the crankshaft.

There will be no increase in cost of manufacture, no new material needed and no special training is required to maintain the engine embodying the present invention.

Thus, the power stroke of the internal combustion engine is improved because it is lengthened and power is applied to the crankshaft in a more effective manner.

DETAILED DESCRIPTION OF THE INVENTION

Other objects, features and advantages of the invention will become apparent from a consideration of the following detailed description and the accompanying drawings.

The piston/cylinder crankshaft combination of the present invention has piston/cylinder oriented at an oblique angle with respect to the crankshaft and delivers power to the crankshaft during a crankshaft rotational angle that is greater than the rotational angle associated with the power stroke of prior art engines. Accordingly, engine efficiency is improved over prior art internal combustion engines.

Figure 1A:
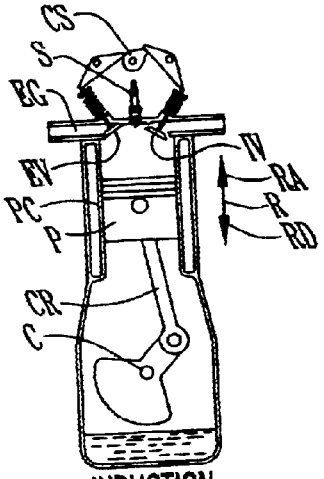
FIG. 1A (PRIOR ART)
FIG. 1A shows the relative orientation of a piston/cylinder combination of the prior art during an induction stroke.
Figure 1B:
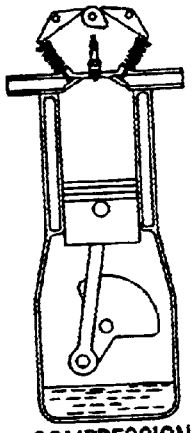
FIG. 1B (PRIOR ART)
FIG. 1B shows the relative orientation of a piston/cylinder combination of the prior art during a compression stroke.

By way of background, a prior art four-cycle internal combustion engine is illustrated in FIGS. 1A–1D as including a piston cylinder PC in which a piston P reciprocates in directions R shown by the double-headed arrow in FIG. 1A. A spark plug SP is located on piston cylinder PC and a camshaft CS controls operation of the piston/cylinder combination in the known manner. An exhaust valve EV and an inlet valve IV are in fluid communication with the inside of piston cylinder PC whereby a fuel/air mixture is inducted into the piston cylinder and exhaust gases EG are conducted out of the piston cylinder in the known manner. A connecting rod CR connects piston P to a crankshaft C to translate reciprocating motion of piston P into rotational motion of crankshaft C.

Figure 1C:
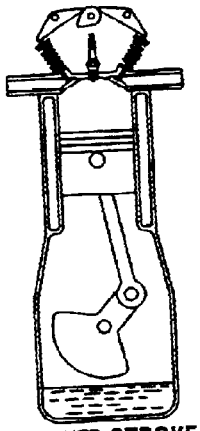
FIG. 1C (PRIOR ART)
FIG. 1C shows the relative orientation of a piston/cylinder combination of the prior art during a power stroke.
Figure 1D:
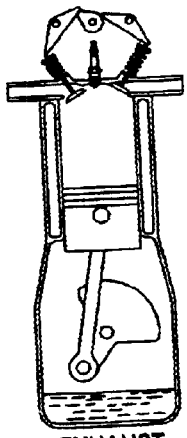
FIG. 1D (PRIOR ART)
FIG. 1D shows the relative orientation of a piston/cylinder combination of the prior art during an exhaust stroke.

As illustrated in FIGS. 1A–1D, the internal combustion engine of the present invention is a four stroke engine in which an induction stroke (FIG. 1A) is carried out while inlet valve IV is open with the piston moving in direction RD to draw fresh fuel/air mixture into cylinder PC. A compression stroke (FIG. 1B) follows in which valves IV and EV are closed, and the pressure of the fuel/air mixture is increased as piston P is moved by the momentum of crankshaft C in direction RA. The compressed mixture of fuel and air is then ignited by activation of spark plug S. The power stroke is shown in FIG. 1C and occurs when the expansion of the exploded gases in cylinder PC forces piston P in direction RD because valves IV and EV are closed. The exhaust stroke (FIG. 1D) occurs with exhaust valve EV open and piston P moving in direction RA under the influence of crankshaft C to force gaseous byproducts of combustion out of exhaust valve EV.

Figure 2:
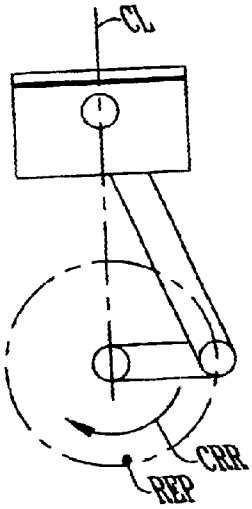
FIG. 2 (PRIOR ART)
FIG. 2 is a schematic illustrating the relative orientation of a prior art piston/cylinder combination and a crankshaft.

The prior art orientation of the piston/cylinder and the crankshaft is illustrated in FIG. 2 with rotation of the crankshaft being illustrated by arrow CRR. As can be understood from FIG. 2, power will be applied to the crankshaft only until a reference point RP has reached a six o'clock position as shown in FIG. 2 as the crankshaft rotates in direction CRR.

Figure 3:
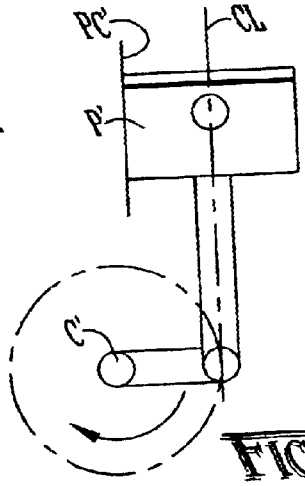
FIG. 3 (PRIOR ART)
FIG. 3 is a schematic illustrating the relative orientation of an offset prior art piston/cylinder combination and a crankshaft.

As indicated in FIG. 3, some prior art internal combustion engines offset piston/cylinder PC' from crankshaft C'. While this has been somewhat successful, further improvement is desirable.

Figure 4:
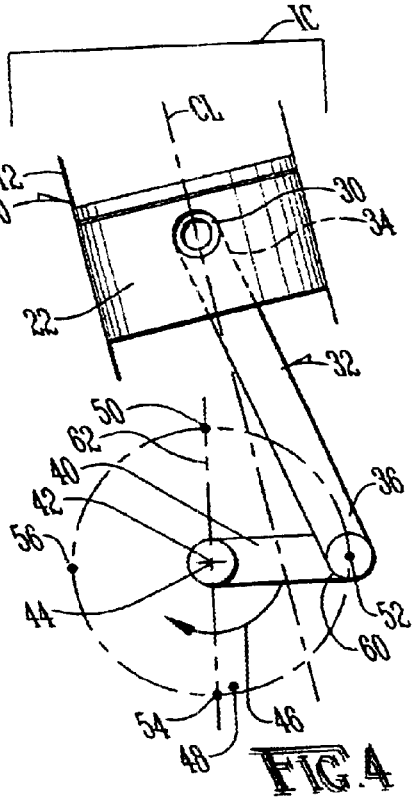
FIG. 4 is a schematic illustrating the relative orientation of the piston/cylinder combination and a crankshaft embodying the teaching of the present invention.
Figure 5:
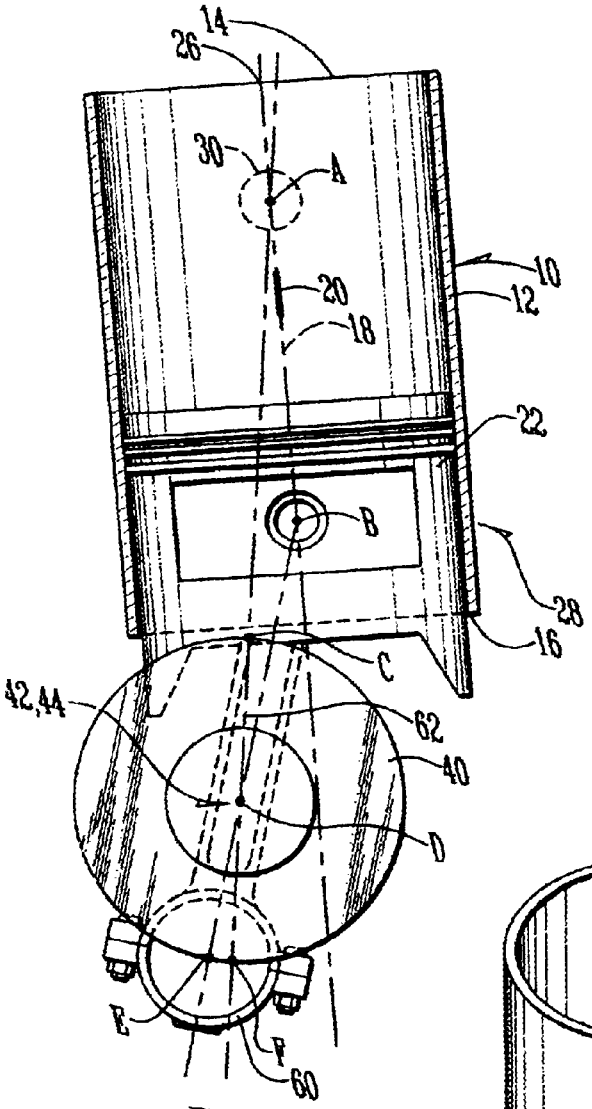
FIG. 5 is a schematic showing the piston/cylinder combination and a crankshaft embodying the teaching of the present invention, illustrating the increase in power stroke.
Figure 6:
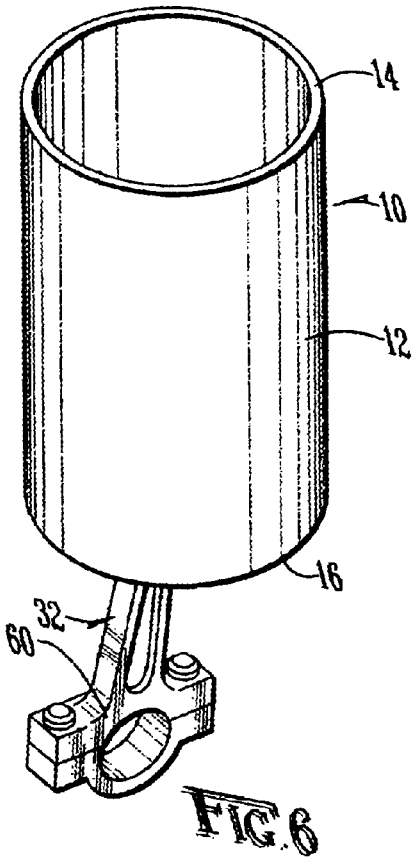
FIG. 6 is a perspective view showing the piston/cylinder combination of the present invention.

Accordingly, referring to FIGS. 4–6, the present invention is embodied in an internal combustion engine IC comprising a piston cylinder 10 having a hollow cylindrical body 12, a first end 14 on body 12, a second end 16 on body 12, a longitudinal axis 18 extending from first end 14 to second end 16, and a reference plane 20 which contains longitudinal axis 18 of piston cylinder 10.

A piston 22 is movably mounted in piston cylinder 10 and moves in piston reference plane 20 between a top dead center location 26 near first end 14 of piston cylinder 10 and a bottom dead center location 28 near second end 16 of piston cylinder 10. Piston 22 moves between top dead center location 26 and bottom dead center location 28 in an induction stroke, a compression stroke, a power stroke and an exhaust stroke during the cycles of the internal combustion engine.

A wrist pin 30 is pivotally connected to piston 22 for movement therewith and a connecting rod 32 has first end 34 connected to wrist pin 30 for movement therewith and a second end 36 spaced from first end 34 of connecting rod 32.

The internal combustion engine further includes a crankshaft 40 spaced from piston 22. Crankshaft 40 includes an axis of rotation 42 and a longitudinal axis 44 extending along the axis of rotation 42. Crankshaft 40 is rotatably mounted to rotate around the axis of rotation 42 in direction 46 and has a reference point 48 thereon that moves between a twelve o'clock location 50, a three o'clock location 52, a six o'clock location 54 and a nine o'clock location 56 as crankshaft 40 rotates about axis of rotation 42. A crankshaft rod journal throw element 60 is fixed to the crankshaft 40 for rotation therewith, and second end 36 of connecting rod 32 is connected to journal throw element 60 and connects piston 22 to the crankshaft 40 and delivers power to crankshaft 40 from piston 22 during the power stroke of the piston 22.

The crankshaft 40 rotates about axis of rotation 42 as piston 22 moves between top dead center location 26 and bottom dead center location 28 during the induction stroke, the compression stroke, the power stroke and the exhaust stroke of piston 22.

As shown in FIGS. 4 and 5, a crankshaft reference plane 62 contains twelve o'clock location 50 and six o'clock location 54 of reference point 48, and reference plane 20 of piston cylinder 10 is oriented at an oblique angle to reference plane 60 of crankshaft 40. The power stroke of piston 22 begins at top dead center.

Figure 7:
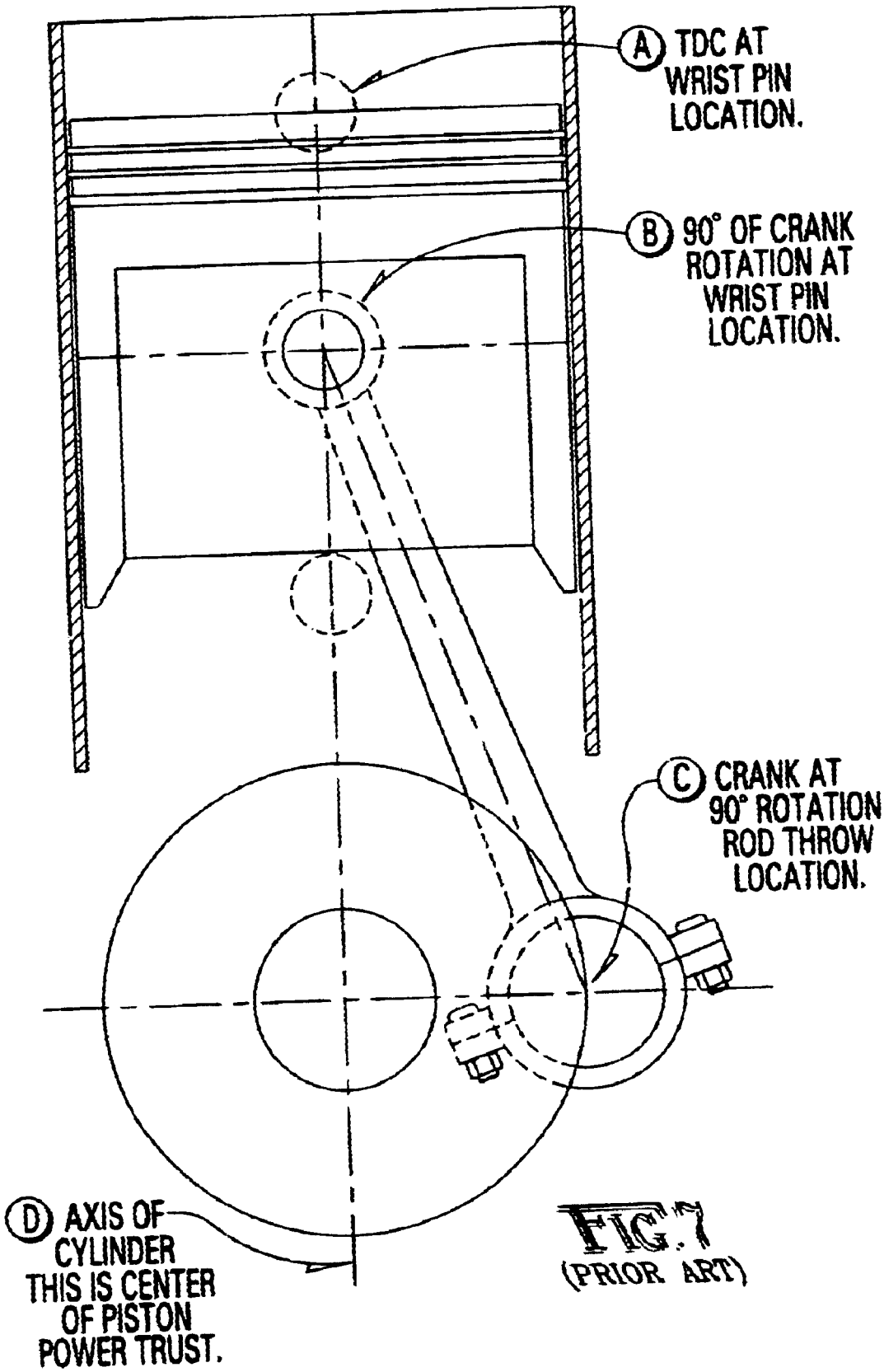
FIG. 7 (PRIOR ART)
FIG. 7 is another schematic showing the relative orientation of the piston/cylinder combination and a crankshaft, illustrating the power stroke.
Figure 8:
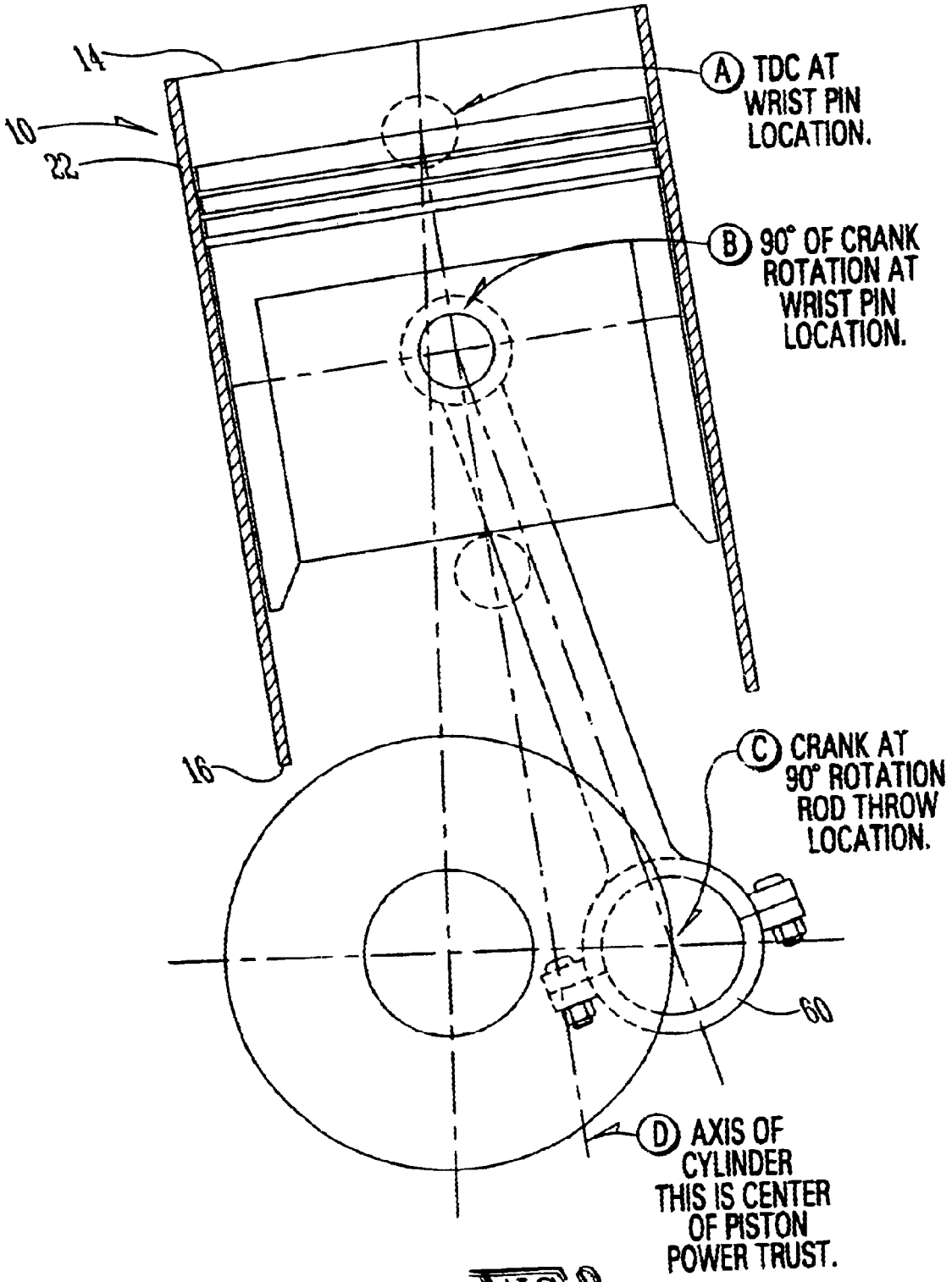
FIG. 8 is another schematic showing the relative orientation of the piston/cylinder combination and a crankshaft embodying the teaching of the present invention and illustrating the power stroke.

As can be understood from FIGS. 7 and 8, by orienting reference plane 20 at an oblique angle to reference plane 62, power is delivered to the crankshaft 40 beyond the six o'clock location 54 of the reference point 48 whereby bottom dead center 28 of the power stroke of the piston 22 produces more than 180 degrees of crank rotation.

Referring to FIG. 5, the gain in efficiency associated with the present invention can be understood. As shown in FIG. 5, point A is top dead center at the wristpin, point B is the bottom dead center of the wristpin, point C is the top dead center location of the connecting throw element, point D is the center of the crankshaft 40, points E and F show the rotation of the crankshaft 40 gained by moving the piston/cylinder as discussed in the above disclosure. This gain is also illustrated by comparing FIGS. 7 and 8.

It is understood that while certain forms of the present invention have been illustrated and described herein, it is not to be limited to the specific forms or arrangements of parts described and shown.

I claim:

1. An internal combustion engine comprising:

a) a piston cylinder having
   (1) a hollow cylindrical body,
   (2) a first end on the body,
   (3) a second end on the body,
   (4) a longitudinal axis extending from the first end to the second end, and
   (5) a reference plane which contains the longitudinal axis of said piston cylinder;

b) a piston movably mounted in said piston cylinder and moving in the piston reference plane between a top dead center location near the first end of said piston cylinder and a bottom dead center location near the second end of said piston cylinder, said piston moving between the top dead center location and the bottom dead center location in an induction stroke, a compression stroke, a power stroke and an exhaust stroke;

c) a wrist pin pivotally connected to said piston for movement therewith;

d) a connecting rod having a first end connected to said wrist pin for movement therewith and a second end spaced from the first end of said connecting rod;

e) a crankshaft spaced from said piston and including
   (1) an axis of rotation,
   (2) a longitudinal axis extending along the axis of rotation, (3) said crankshaft being rotatably mounted to rotate around the axis of rotation and having a reference point thereon that moves between a twelve o'clock location, a three o'clock location, a six o'clock location, and a nine o'clock location as said crankshaft rotates about the axis of rotation, (4) a crankshaft rod journal throw element fixed to said crankshaft for rotation therewith, (5) the second end of said connecting rod being connected to the journal throw element and connecting said piston to said crankshaft and delivering power to said crankshaft from said piston during the power stroke of said piston, (6) said crankshaft rotating about the axis of rotation as said piston moves between the top dead center location and the bottom dead center location during the induction stroke, the compression stroke, the power stroke and the exhaust stroke of said piston, (7) a crankshaft reference plane containing the twelve o'clock location and the six o'clock location of the reference point; and (8) the reference plane of said piston cylinder being oriented at an oblique angle to the reference plane of said crankshaft and the power stroke of said piston beginning at top dead center; and f) wherein the location of the wrist pin at bottom dead center is spaced forward of a line defined by the location of the wrist pin at top dead center and the axis of rotation of the crankshaft, and wherein a downstroke of the piston causes the crankshaft to rotate about the axis of rotation more than 180° by the amount of the arc length between a first line defined by the location of the wrist pin at top dead center and the axis of rotation of the crankshaft and a second line defined by the location of the wrist pin at bottom dead center and the axis of rotation of the crankshaft.

2. The internal combustion engine as described in claim 1 wherein the power stroke of said piston begins when the throw element of said crankshaft is at top dead center and ends when the throw element of said crankshaft has rotated past the six o'clock location and is located between the six o'clock location and the nine o'clock location.

3. The internal combustion engine as described in claim 1 in which the bottom dead center of the power stroke produces rotation of said crankshaft of more than 180 degrees.

4. An internal combustion engine comprising:

a) a piston cylinder having a longitudinal axis and a reference plane which contains the longitudinal axis;

b) a crankshaft having a longitudinal axis and an axis of rotation around the longitudinal axis, a reference point on said crankshaft which moves between a twelve o'clock location and a three o'clock location as said crankshaft rotates about the axis of rotation;

c) a reference plane in the crankshaft that contains the twelve o'clock location and the six o'clock location on the crankshaft;

d) a piston movably mounted in said piston cylinder to move in a power stroke within said piston cylinder;

e) a connecting rod connecting said piston to said crankshaft and transferring power to said crankshaft from said piston during the power stroke of said piston; and f) the reference plane of said piston cylinder being oriented at an oblique angle to the reference plane of said crankshaft, and g) wherein the location of the upper end of the connecting rod at bottom dead center is moved forward of a line defined by the location of the upper end of the connecting rod at top dead center and the longitudinal axis of the crankshaft, and wherein a downstroke of the piston causes the crankshaft to rotate more than 180° by the amount of the arc length between a first line defined by the location of the upper end of the connecting rod at top dead center and the longitudinal axis of the crankshaft and a second line defined by the location of the upper end of the connecting rod at bottom dead center and the longitudinal axis of the crankshaft.

* * * * *